US005208607A

United States Patent [19]

Ohashi et al.

[11] Patent Number: 5,208,607

[45] Date of Patent: May 4, 1993

[54] THERMAL RECORDING METHOD USING DRIVE SIGNAL PULSE WIDTHS CHANGED AT TIME INTERVALS WITHIN THERMAL HEAD TEMPERATURE MEASURING TIME INTERVALS

[75] Inventors: Takeo Ohashi, Isehara; Takahiko Tokumasu, Atsugi, both of Japan

[73] Assignee: Ricoh Company, Ltd., Tokyo, Japan

[21] Appl. No.: 753,074

[22] Filed: Aug. 30, 1991

[30] Foreign Application Priority Data

Sept. 3, 1990 [JP] Japan .....2-233018

[51] Int. Cl.[5] ..... B41J 2/365

[52] U.S. Cl. ..... 346/1.1; 346/76 PH

[58] Field of Search ..... 346/76 PH, 1.1; 400/120

[56] References Cited

U.S. PATENT DOCUMENTS 5,006,866 4/1991 Someya ..... 346/76 PH
5,046,859 9/1991 Yamaguchi ..... 346/76 PH

FOREIGN PATENT DOCUMENTS 55-142675 11/1980 Japan .
0135970 8/1984 Japan ..... 346/76 PH
0029558 2/1986 Japan ..... 346/76 PH
0238764 10/1987 Japan ..... 400/120

*Primary Examiner*—Benjamin R. Fuller
*Assistant Examiner*—N. Le
*Attorney, Agent, or Firm*—Oblon, Spivak, McClelland, Maier & Neustadt

[57] ABSTRACT

A heat-sensitive recording method of performing a thermal printing at variable printing time intervals by a thermal head in a facsimile apparatus. The method includes the steps of determining a pulse width corresponding to a thermal head temperature, from a measured resistance of a thermistor measured at a first time interval, on the basis of a relationship between thermal head temperature and pulse width, storing the determined pulse width corresponding to the temperature in a first memory area and storing a recording power pulse width corresponding to the pulse width in a second memory area, and correcting the recording power pulse width on the basis of a relationship between thermistor resistance and thermal head temperature by changing the recording power pulse width at a second time interval by comparing the same with the pulse width, so that a thermal printing is performed in which the recording power pulse width is varied in gradual steps by applying a printing power pulse with the thus corrected pulse width to the thermal head.

4 Claims, 10 Drawing Sheets

$T_0 = T_1 = T_2 = T_3 = T_4 < T_5 < T_6 < T_7$ $H_0 > H_1 > H_2 > H_3 > H_4 = H_5 = H_6 = H_7$

THERMAL RECORDING METHOD USING DRIVE SIGNAL PULSE WIDTHS CHANGED AT TIME INTERVALS WITHIN THERMAL HEAD TEMPERATURE MEASURING TIME INTERVALS

BACKGROUND OF THE INVENTION

The present invention relates generally to a heat-sensitive recording method, and more particularly to a heat-sensitive thermal recording method applicable to a facsimile apparatus, in which excessive dot density variations appearing when a conventional method is performed can be reduced.

When high speed printing is performed by means of a conventional thermal recording apparatus, the printing dot density is unfavorably varied depending on the time intervals at which image data is printed on record paper. For example, in a case in which a heat-generating element of the thermal recording apparatus, or a so-called thermal head, is thermally driven by recording power pulses at time intervals of 1.8 msec, an image is formed with dots printed on record paper at a prescribed printing dot density. The operating condition of the thermal head in this case is periodically returned from a heated condition to a base temperature level every 10 msec. The printing dot density is determined primarily depending on the thermal energy applied from the thermal head to a color agent or image transfer agent with which an image is thermally recorded on record paper. The greater the thermal energy being applied by the thermal head in a heated condition is, the higher the printing dot density is. Accordingly, the conventional printing apparatus performs a thermal printing at subsequent timings while the operating condition is periodically returned to a base temperature level.

However, in a case in which the above mentioned recording method is performed, it is difficult to keep up with a high speed printing at a printing time period of 2.0 msec or below. When the thermal head performs a printing of subsequent dots on record paper, it still remains in a heated condition and is not returned to a base temperature level.

Some improved thermal recording methods have been proposed in order to eliminate the above mentioned problem. For example, Japanese Laid-Open Patent Application No.55-142675 discloses a heat-sensitive recording device which performs such an improved thermal recording method. In this conventional device, characteristics data of its thermal head defining a relationship between the printing time period and the recording power pulse duration or pulse width is previously stored, and an intended printing dot density is achieved by the printing time period thus stored. The actual printing time period of the thermal head is measured, and the widths of recording power pulses by which the thermal head is thermally driven are selectively determined on the basis of the characteristics data using the measured printing time period. Thus, the thermal head of the conventional apparatus can start printing at the intended printing dot density in its heated condition. Also, the conventional apparatus is operable in a case in which a printing time period intended for the printing is variable. Other improved thermal recording methods have been proposed, and the above mentioned problem is eliminated in those improved methods, for example, by changing the operating condition of the thermal head rapidly from a heated condition to a base temperature level, or by selecting a pulse width in response to the thermal head temperature.

A description will now be given of a relationship between the thermal head temperature and the recording power pulse width in a heat-sensitive recording apparatus. Generally speaking, it is desired that a heat-sensitive recording apparatus can provide an appropriate printing dot density in performing a heat-sensitive recording and no excessive printing density variations are produced. One conceivable method for reducing such undesired printing density variations is that the recording power pulse width Hpw is varied suitably with respect to the thermal head temperature T.

FIG. 2A shows an ideal characteristics chart which indicates a relationship between the thermal head temperature T and the recording power pulse width Hpw. As shown in FIG. 2A, this relationship is represented by two straight lines with different inclinations, the straight lines having an intersecting point appropriately at 20 deg C. In many cases, the characteristics chart indicating the relationship between the temperature T and the pulse width Hpw can be approximated by two such straight lines. An ideal method for eliminating the above mentioned problem is to select accurately a recording power pulse width Hpw on the basis of the characteristics chart as shown in FIG. 2A from the respective thermal head temperatures. However, in practical cases, only a few values of the recording power pulse width Hpw are predetermined for the respective temperatures T in the applicable temperature range (the range between 5 deg C and 60 deg C, for example), and a staircase-like chart formed with vertical and horizontal straight lines shown in FIG. 2B which can be approximate to the ideal characteristics chart shown in FIG. 2A is applied.

FIG. 3 shows a heat-generating portion of a heat-sensitive recording system. In FIG. 3, an 8-bit counter 31, a Schmitt input 32 and an open drain output 33 are provided for measuring a resistance value of a thermistor 34. The thermistor 34 is usually provided within a thermal head as the heat-generating element, and a resistor 35 with a resistance Ro is connected in parallel to the thermistor 34. The thermal head temperature T is determined from a resistance value of the thermistor which is measured with the 8-bit counter 31, and, from the thermal head temperature T thus determined, the recording power pulse width Hpw is selected o the basis of the characteristics chart. In general, the thermistor resistance value Th which can be measured with the 8-bit counter 31 is represented by the following formula:

$$Th_n = Ro \exp B\,(1/Tn - 1/To)$$

In this formula, $Th_n$ is a thermistor resistance value at a thermal head temperature $T_n$ deg C, Ro is the thermistor resistance value at To deg C, B is the thermal sensitivity coefficient, and To is the reference temperature which is, for example, 25 deg C (298.15 K). As is apparent from this formula, the relationship between the thermistor resistance Th and the thermal head temperature T can be shown as a hyperbolic chart.

FIGS. 4A and 4B are hyperbolic charts each indicating the relationship between the thermistor resistance $Th_n$ and the thermal head temperature $T_n$. FIG. 4A shows a case in which the thermistor resistance values are separated into constant steps $Th_n - Th_{n-1} = h$:constant ). As is apparent from FIG. 4A, steps of the thermal head temperatures T corresponding to the thermistor resistance values Th with constant steps h become greater as the thermal head temperature T becomes higher ( $T1<T2<T3< \ldots <T_n$). Therefore, the relationship between the pulse width Hpw and the temperature T, as shown in FIG. 5, can be explained as follows: in a lower temperature range the pulse width Hpw can be approximate to the ideal case, but, in higher temperatures, steps of the pulse width Hpw become 1 excessively great, which will produce excessive printing dot density variations in a printed image.

On the other hand, FIG. 4B shows a case in which the thermal head temperatures are separated into constant steps ($T_1-T_{n-1}$=t:constant). In this case, as shown in FIG. 4B, the changes of the thermistor resistance Th corresponding to the thermal head temperature T with constant steps t become smaller and smaller as the temperature T becomes higher ($Th_1>Th_2>Th_3> \ldots >Th_n$).

Therefore, in practical cases, the changes in the actually measured thermistor resistance Th cannot keep up with the changes in the intended recording power pulse width Hpw, and, consequently, the steps of the pulse width Hpw in a higher temperature range will not become constant, while in a lower temperature range the steps of the pulse width Hpw will be varied very coarsely. Thus, in the case in which the conventional thermal recording apparatus is used, there is a problem in that excessive variations in printing dot density are produced, because the steps of the thermistor resistance value Th actually measured cannot keep up with the steps of the intended recording power pulse width Hpw.

SUMMARY OF THE INVENTION

Accordingly, it is a general object of the present invention to provide an improved heat-sensitive thermal recording method in which the above described problems are eliminated.

Another and more specific object of the present invention is to provide a heat-sensitive thermal recording method which can reduce undesired dot density variations by adjusting appropriately recording power pulse widths which have been determined from thermistor resistance values measured. The above mentioned object of the present invention can be achieved by a heat-sensitive thermal recording method of performing a thermal printing at variable printing time intervals by a heat-generating element in a facsimile apparatus having a memory part in which a pulse width table defining a relationship between heat-generating element temperature and measurement pulse width is stored, comprising steps of setting a temperature of the heat-generating element from a resistance of a thermistor provided within he heat-generating element, the resistance of the thermistor being measured at a first time interval, determining a measurement pulse width corresponding to the heat-generating element temperature o the basis of the pulse width table stored in the memory part, storing the measurement pulse width corresponding to the temperature in a first memory area and storing a recording power pulse width corresponding to the measurement pulse width in a second memory area, and correcting the recording power pulse width stored in the second memory area on the basis of a relationship between thermistor resistance and heat-generating element temperature by changing the recording power pulse width at a second time interval through comparison of the same with the measurement pulse width, so that a thermal printing is performed in which the recording power pulse width is varied in gradual steps by applying a recording power pulse with the thus corrected pulse width to the heat-generating element. According to the present invention, it is possible to vary recording power pulse widths appropriately, even when the thermal head operates at high temperatures, thus preventing excessive printing dot density variations from being produced. The widths of recording power pulses which are applied to drive and operate the thermal head are determined from the thermal head temperature obtained from the measured thermistor resistance, but they are adjusted and changed in gradual steps on the basis of the printing time periods and pulse width changes.

Other objects and further features of the present invention will become more apparent from the following detailed description when read in conjunction with the accompanying drawings.

DESCRIPTION OF THE PREFERRED EMBODIMENT

Figure 2A:
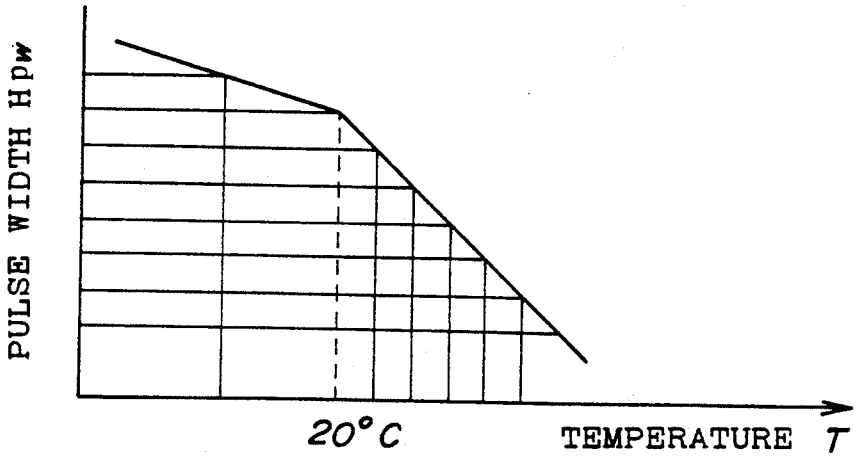
FIGS. 2A and 2B are charts for explaining a relationship between thermal head temperature and recording power pulse width which is used by the heat-sensitive thermal recording method of the present invention.
Figure 2B:
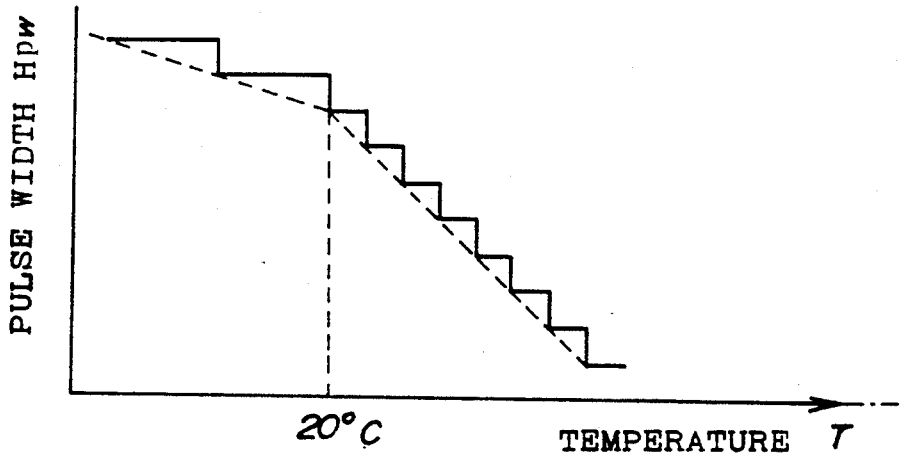
Figure 3:
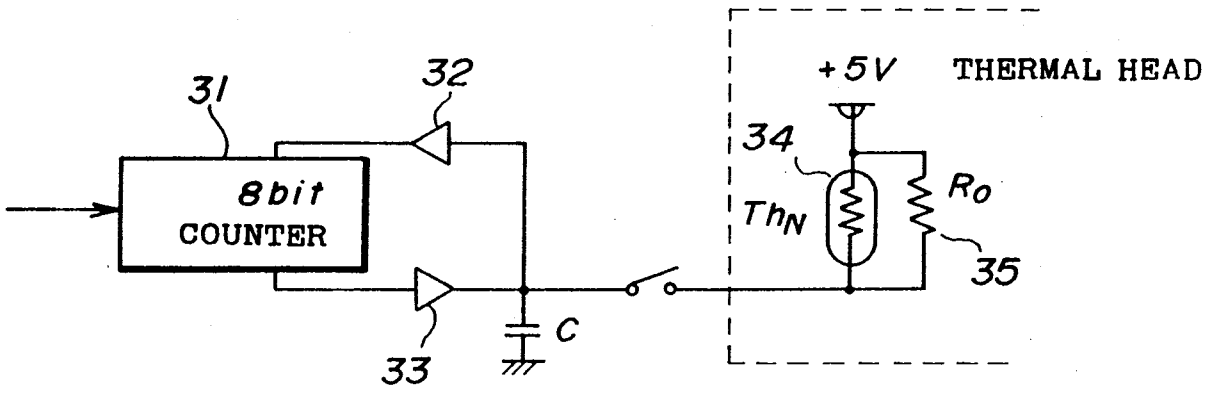
FIG. 3 is a block diagram showing a heat generating part of a thermal recording system to which the present invention may be applied.
Figure 6:
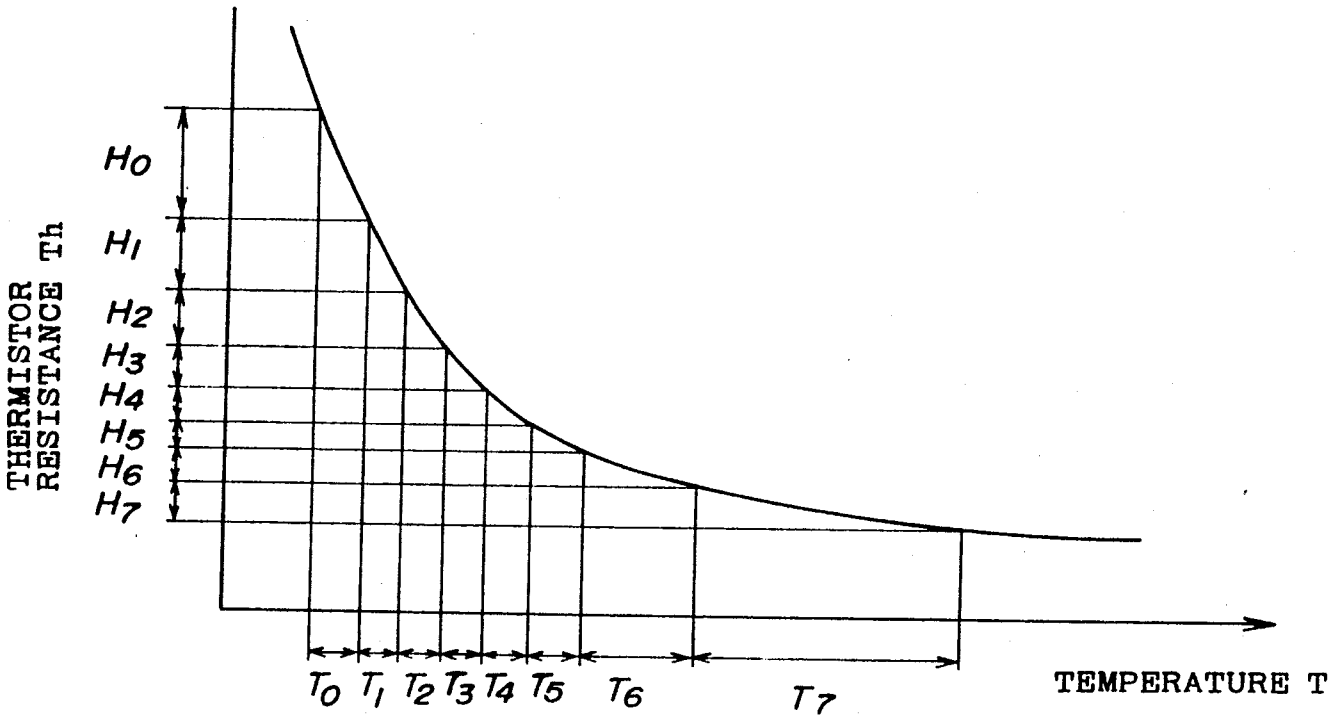
FIG. 6 is a chart showing a relationship between thermistor resistance and thermal head temperature.

First, a description will be given of the principles of a heat-sensitive recording method according to the present invention. FIG. 6 shows a relationship between the thermistor resistance value Th and the thermal head temperature T in a thermal recording system to which the present invention may be applied. As discussed above in conjunction with FIG. 2B, in order to perform a heat-sensitive printing appropriately by a thermal head within which a thermistor is provided as shown in FIG. 3, it is necessary that the recording power pulse widths are varied suitably in constant and fine steps with respect to changes in the thermal head temperature. When the thermal head operates at lower temperatures, the approximation of the recording power pulse widths could approach the ideal case if the steps of the thermal head temperature in the characteristics chart are made smaller.

Figure 4A:
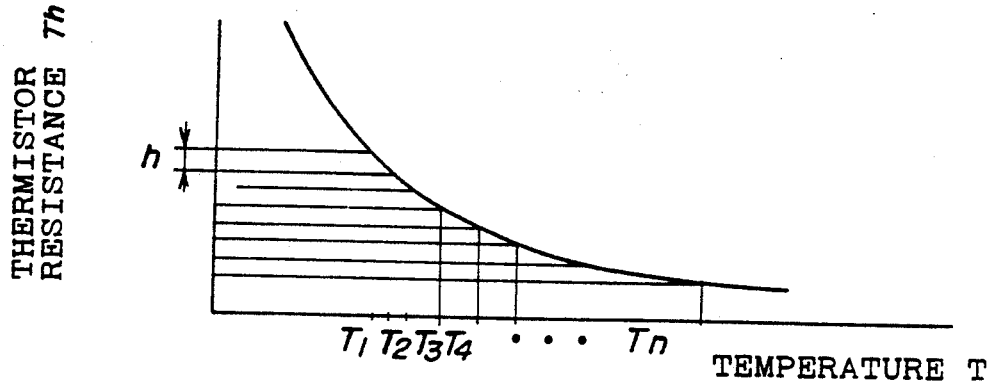
FIGS. 4A and 4B are charts for explaining a relationship between thermistor resistance and thermal head temperature.
Figure 4B:
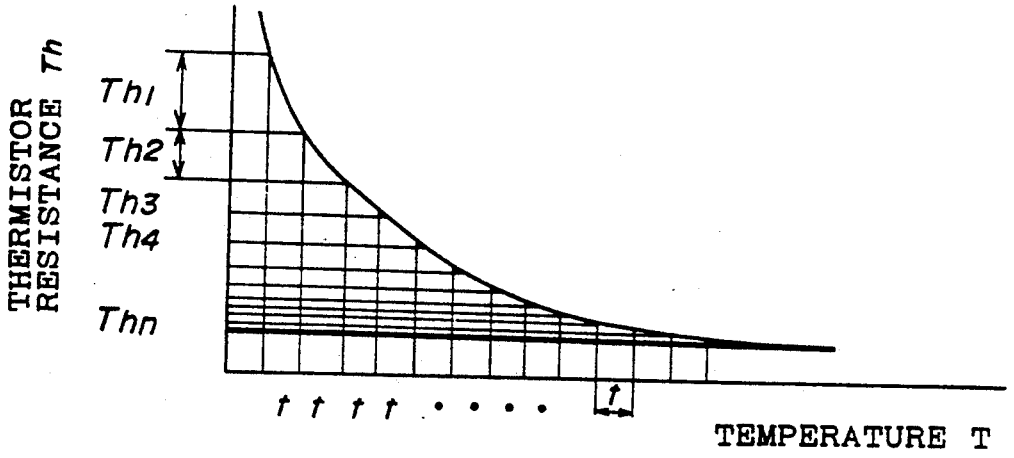
Figure 5:
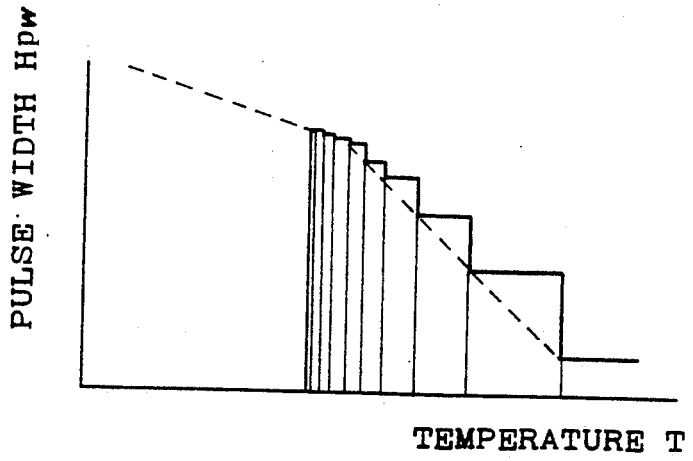
FIG. 5 is a chart showing a relationship between recording power pulse width and thermal head temperature in a case in which the thermistor resistance values are separated into constant steps.

However, as is apparent from FIG. 4B, changes in the thermistor resistance Th corresponding to the thermal head temperature T at lower temperatures are great, and the thermistor resistance Th can be measured accurately when the thermal head operates at a low temperature. But, when the thermal head operates at higher temperatures, the changes in the thermistor resistance Th become smaller and smaller. In practical cases, as shown in FIG. 6, the changes on the thermistor resistance when the thermal head temperature is higher than a certain level are approaching zero, and the corresponding thermistor resistances are all determined as being equal to a fixed value.

Figure 7:
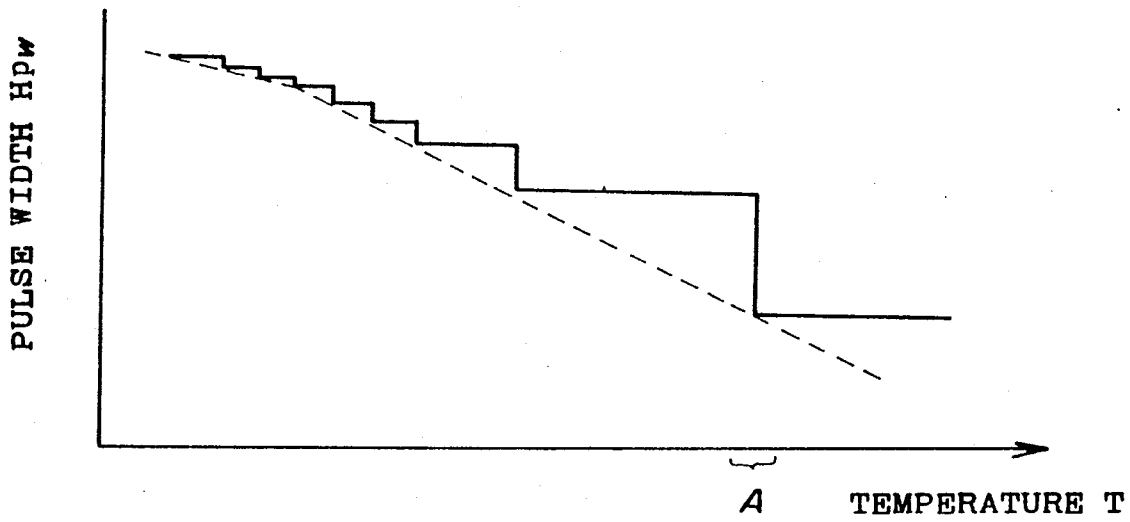
FIG. 7 is a chart for explaining a correction procedure which is performed in an embodiment of the present invention.

FIG. 7 is a corrected characteristics chart indicating a relationship between the recording power pulse width Hpw and the thermal head temperature T which is used in an embodiment of the present invention. This chart can be made by correcting a relationship between the pulse width and the temperature as indicated in the chart shown in FIG. 2B. In the relationship between the pulse width and the temperature as shown in FIG. 7, the pulse widths in a lower temperature range of the thermal head can be approximated to the ideal case, but the steps of the pulse width in a higher temperature range of the thermal head become greater and greater. If a heat-sensitive recording is performed on the basis of the characteristics data as shown in FIG. 7, the steps of the recording power pulse width with respect to changes in the temperature become excessively great when the thermal head temperature is higher than the temperature at a point indicated by a letter A in FIG. 7, which will result in undesired printing dot density variations to be produced.

Figure 8:
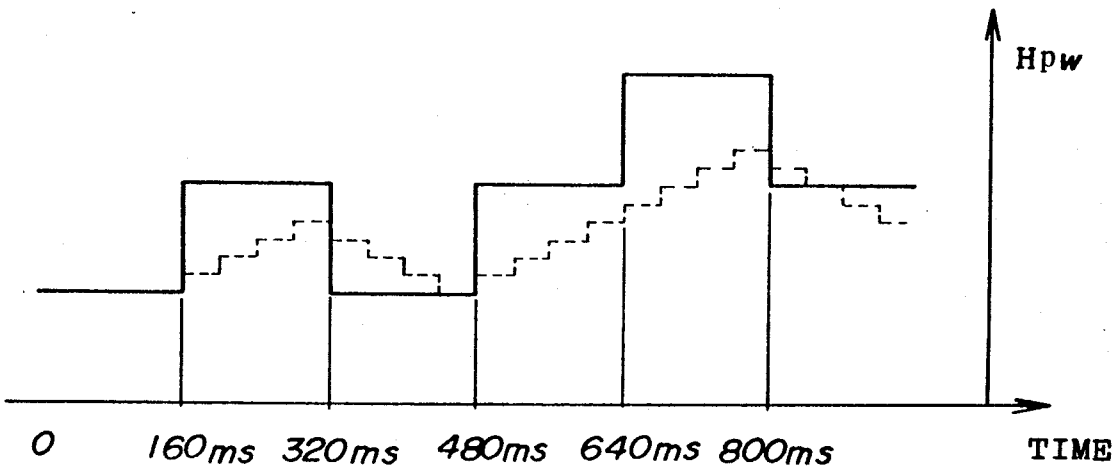
FIG. 8 a chart showing a relationship between the measurement pulse width and the recording power pulse width which is used in an embodiment of the present invention.

FIG. 8 shows a relationship between the recording power pulse width and the elapsing time. In this case, the thermistor resistance is measured at time intervals of 160 msec, for example, so that a temperature of the thermal head is determined. From the determined thermal head temperature, the recording power pulse width is set on the basis of the characteristics chart defining a relationship between the recording power pulse width and the thermal head temperature. However, the changes in the pulse width Hpw, corresponding to the changes in the temperature T, are excessively great, as indicated by a solid line in FIG. 8.

According to the present invention, it is possible to reduce excessively great variations of the recording power pulse widths as described above, so that the recording power pulse widths are varied in gradual steps as indicated by a dotted line in FIG. 8. In a case of the present embodiment, the time interval (160 msec) at which the thermistor resistance is periodically measured is divided into four equal time periods (40 msec), and the recording power pulse widths are suitably adjusted at time intervals of 40 msec through comparison of the same with the measurement pulse widths, on the basis of a relationship between the thermal head temperature and the thermistor resistance, so that the pule widths are varied in gradual steps.

Figure 9:
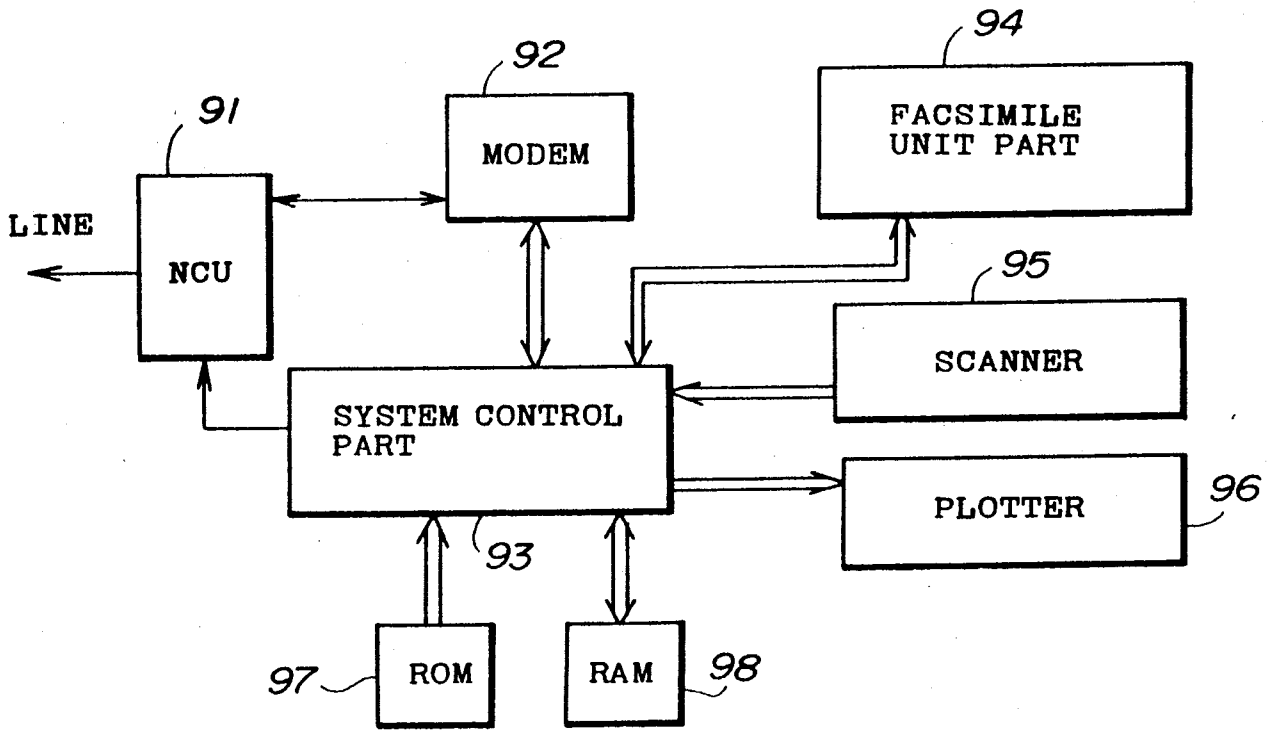
FIG. 9 is a block diagram showing a heat-sensitive recording system to which the present invention is applied.

Next, a description will be given of a facsimile system to which the present invention is applied, with reference to FIG. 9. In FIG. 9, this facsimile system includes a network control unit (NCU) 91, a modem 92 for modulating and demodulating signals transmitted to and received from a network, a system control part 93 for controlling operations of the facsimile system, the system control part 93 having a ROM (read-only memory) 97 and a RAM (random access memory) 98, a facsimile unit part 94 including other facsimile units, a scanner unit 95 for scanning a document including information to be transmitted, and a plotter 96 for printing out a received image data on record paper. The plotter 96 of the facsimile system includes a thermal head as the heat-generating element, and this thermal head, similar to that shown in FIG. 3, has a thermistor, a resistor and and a 8-bit counter for measuring a resistance value of the thermistor. From the measured thermistor resistance value, a temperature of the thermal head is determined on the basis of a characteristics table defining a relationship between the thermistor resistance and the thermal head temperature.

From the thus determined thermal head temperature, the recording power pulse width is determined on the basis of a characteristics table indicating a relationship between the recording pulse width and the thermal head temperature, stored in the ROM 97, and data stored in the RAM 98. According to the present invention, the recording pulse width is changed in gradual steps by appropriate adjustment of the pulse widths which is performed at time intervals of 40 msec into which the 160-msec time period of the thermal head setting is divided.

The recording pulse width vs. temperature table is stored in the ROM 97, those temperatures defined in the table each being determined from the measured thermistor resistance values. The RAM 98 includes at least two storage areas, one of the two areas a measurement pulse width storage area 98*a* and the other a printing pulse width storage area 98*b*. A measurement pulse width, corresponding to the temperature determined based on the characteristics table in the ROM 97 from the measured resistance, is set in the area 98*a* of the RAM 98 at time intervals of 160 msec. A recording power pulse width used in the actual recording is determined and set in the area 98*b* at time intervals of 40 msec. With the facsimile system thus constructed, the present invention can reduce undesired excessive variations of printing dot density even when the thermal head operates at higher temperatures, which variations may appear when the conventional recording method is used.

Figure 1A:
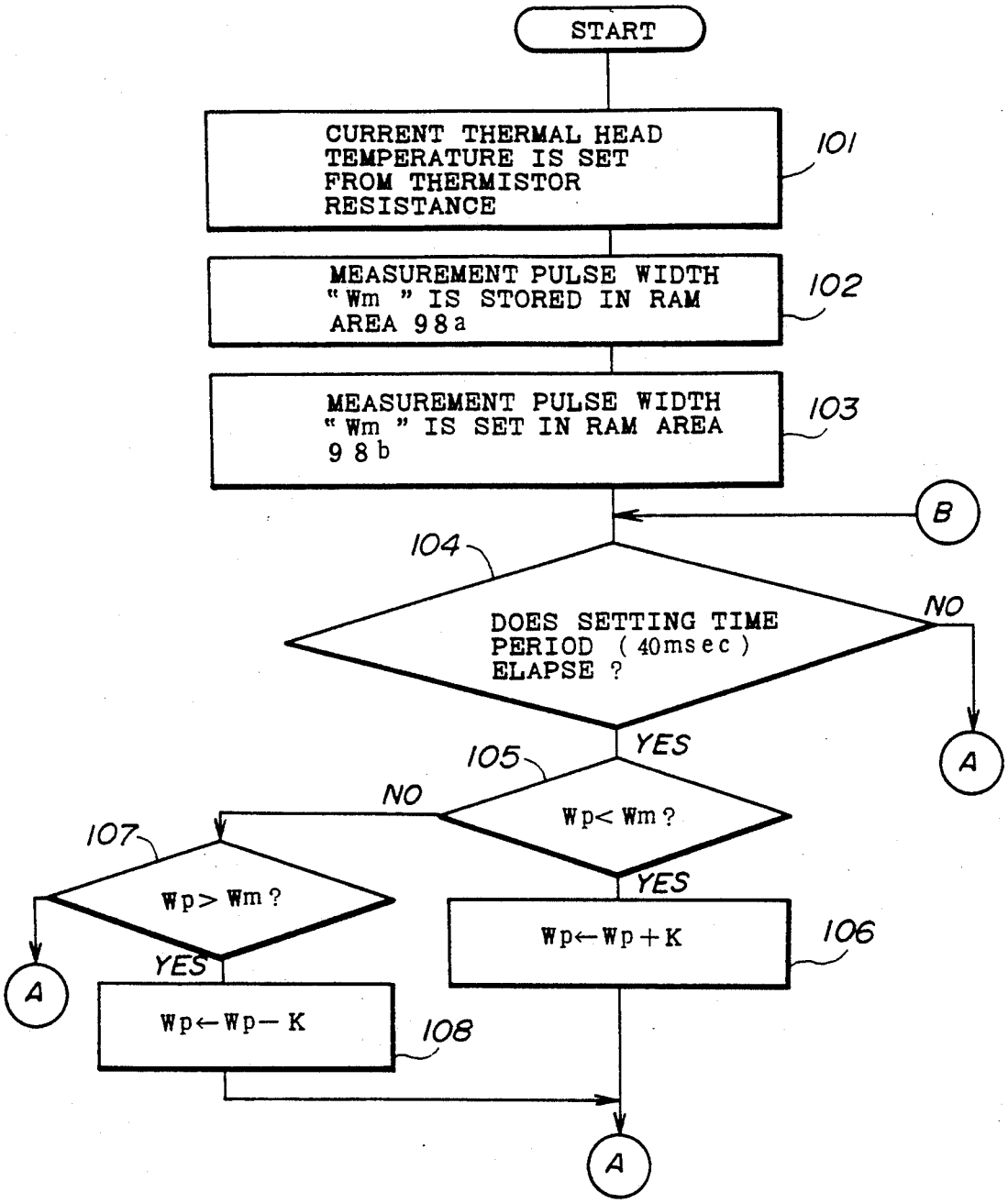
FIGS. 1A and 1B are a flow chart for explaining an embodiment of a heat-sensitive thermal recording method according to the present invention.
Figure 1B:
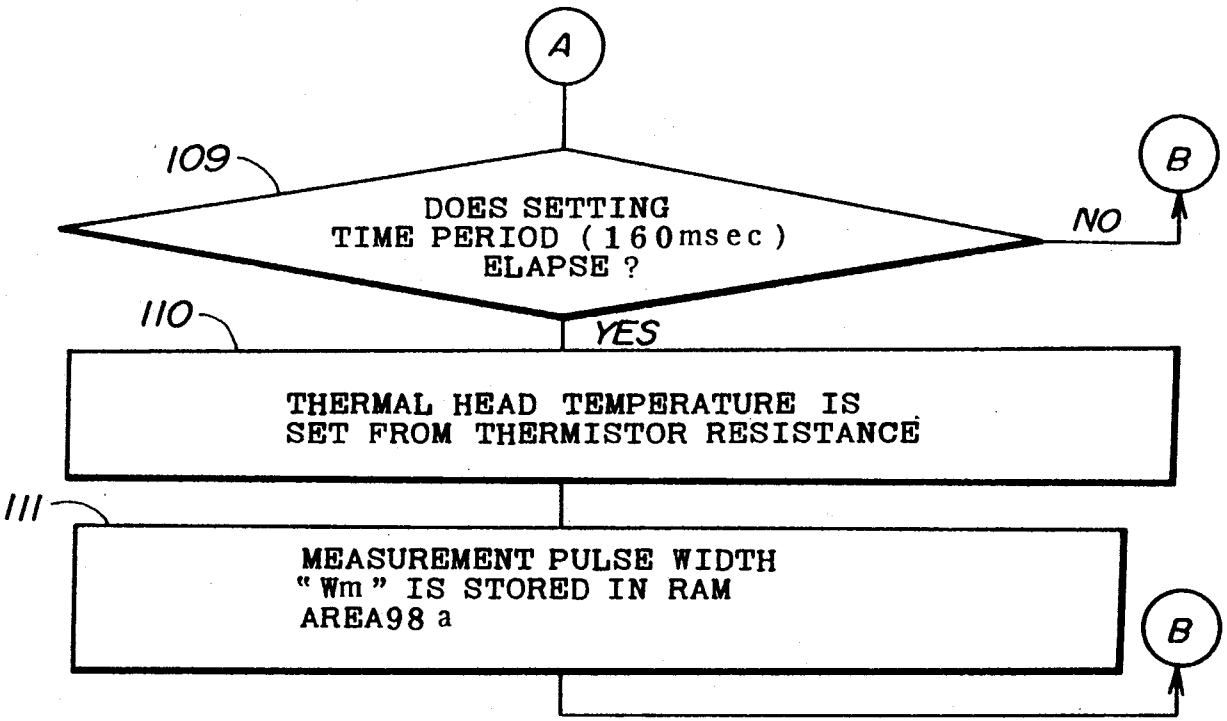

Next, a thermal recording procedure of the heat-sensitive recording method according to the present invention will be described. In the flow chart shown in FIGS. 1A and 1B, a step 101 sets the current temperature of the thermal head from a thermistor resistance value which is currently measured with the 8-bit counter from the thermistor provided within the plotter 96. A step 102 reads out a measurement pulse width Wm, corresponding to the current thermal head temperature in the step 101, from the characteristics table stored in the ROM 97, and stores this measurement pulse width Wm in the area 98*a* in the RAM 98.

A step 103 transfers the measurement pulse width Wm stored in the area 98*a* of the RAM 98 to the area 98*b* of the RAM 98. A step 104 checks whether a predetermined setting time period for periodically setting a recording power pulse width Wp, used in the actual printing, elapses or not, this setting time period being preset to 40 msec in this case. Each time the setting time period of 40 msec elapses, the recording power pulse width Wp is suitably adjusted or renewed and set in the area 98*b* of the RAM 98 as follows. A step 105 determines whether the recording power pulse width Wp is smaller than the measurement pulse width Wm. If the step 105 determines that the recording power pulse width Wp is smaller than the measurement pulse width Wm, then a step 106 adjusts the previous recording power pulse width Wp into a new recording power pulse width by adding a value K to the previous recording power pulse width ( Wp←Wp+K ). This value K is predetermined from the thermal head temperature on the basis of the characteristics table stored in the ROM 97. If the step 105 determines that the recording power pulse width Wp is not smaller than the measurement pulse width Wm, then a step 107 determines whether the recording power pulse width Wp is greater than the measurement pulse width Wm. If the Wp is greater than the Wm, then a step 108 adjusts the previous recording power pulse width Wp into a new recording power pulse width by subtracting a value K from the previous recording power pulse width ( Wp←Wp−K). This value K is also predetermined from the thermal head temperature on the basis of the characteristics table stored in the ROM 97.

A step 109 checks whether a predetermined setting time period for setting the measurement pulse width elapses or not, and this predetermined setting is equal to, for example, 160 msec. Each time the setting time period of 160 msec elapses, a measurement pulse width is renewed and set. A step 110 sets a temperature of the thermal head from a thermistor resistance value of the thermistor, provided within the plotter 96, which is measured with the 8-bit counter. A step 111 reads out a measurement pulse width corresponding to the above thermal head temperature from the characteristics table stored in the area 98*a* in the RAM 98. Then, the procedure is returned to the step 104. When the setting time period of 160 msec does not elapse yet, the procedure is returned to the step 104 and the above described steps 105 to 108 are repeated.

In the present embodiment, the setting time period of 160 msec is divided into four equal time periods of 40 msec, and the adjustment of the pulse widths is performed. In a modified embodiment of the present invention, however, it is possible to adjust the pulse widths by multiplying the setting time period of 160 msec.

Further, the present invention is not limited to the above described embodiment, and variations and modifications may be made without departing from the scope of the present invention.

What is claimed is:

1. A heat-sensitive thermal recording method of performing a thermal printing at variable printing time intervals by a heat-generating part in a facsimile system having a memory part in which a pulse width table defining a relationship between heat-generating part temperature and measurement pulse width is stored, said heat-sensitive thermal recording method comprising steps of:

measuring a temperature of the heat-generating part from a resistance of thermistor provided within the heat-generating part, said resistance of said thermistor being measured at a first time interval;

determining a measurement pulse width corresponding to said heat-generating part temperature in accordance with said pulse width table stored in said memory part;

storing said measurement pulse width corresponding to said temperature in a first memory area;

periodically determining a recording power pulse width and storing the recording power pulse width in a second memory area;

detecting whether the recording power pulse width stored in the second memory area is smaller than the measurement pulse width stored in the first memory area; and correcting said recording power pulse width stored in said second memory area into a new recording power pulse width at a second time interval, said new recording power pulse width being generated by one of (a) adding a predetermined value to the recording power pulse width stored in said second memory area when said recording power pulse width is smaller than said measurement pulse width; and (b) subtracting the predetermined value from said recording power pulse width when it is greater than said measurement pulse width; so that a thermal printing is performed in which the recording power pulse width is varied in gradual steps by applying a printing power pulse with the thus corrected pulse width to the heat-generating part;

wherein said predetermined value is set from the heat-generating part temperature in accordance with a relationship between thermistor resistance and heat-generating part temperature;

wherein said first time interval at which said resistance of said thermistor is measured is divided into small time intervals each of which is equal to said second time interval at which said recording power pulse width stored in the second memory area is corrected.

2. The method as claimed in claim 1, wherein said first time interval is equal to 160 milliseconds and said second time interval is equal to 40 milliseconds.

3. The method as claimed in claim 1, wherein said facsimile system includes said memory part in which said pulse width table is stored, and a second memory part having said first and second memory areas, said measurement pulse width being stored in said first memory area and said recording power pulse width being stored in said second memory area.

4. The method as claimed in claim 1, wherein heat-generating part temperature values included in said pulse width table stored in said memory part are defined such that said temperature values in a predetermined temperature range are varied in equal steps with respect to changes in measurement pulse width values.

* * * * *